United States Patent [19]

Wuttke

[11] 4,054,349

[45] Oct. 18, 1977

[54] APPARATUS FOR ESTABLISHING MULTI-POINT ELECTRICAL CONTACT WITH AN INSULATED CONDUCTOR

[75] Inventor: Rudolph A. Wuttke, Fort Wayne, Ind.

[73] Assignee: General Electric Company, Fort Wayne, Ind.

[21] Appl. No.: 455,831

[22] Filed: Mar. 28, 1974

[51] Int. Cl.[2] ..... H01R 11/24

[52] U.S. Cl. ..... 339/99 R; 339/255 P

[58] Field of Search ..... 339/95 B, 95 D, 97 R, 339/228, 255 R, 255 L, 255 P, 95 R, 261 R, 97 C

[56] References Cited

U.S. PATENT DOCUMENTS

| | | | |
|---|---|---|---|
| 1,290,153 | 1/1919 | Fitzpatrick | 339/98 |
| 3,176,256 | 3/1965 | Turinsky | 339/255 P X |
| 3,340,473 | 9/1967 | Hertzler | 339/255 P X |
| 3,391,379 | 7/1968 | Smotherman | 339/255 R X |
| 3,549,786 | 12/1970 | Kuo | 339/95 R |
| 3,825,881 | 7/1974 | Wigby | 339/97 R |
| 3,835,241 | 9/1974 | Masterson et al. | 339/98 X |

*Primary Examiner*—Roy Lake
*Assistant Examiner*—E. F. Desmond
*Attorney, Agent, or Firm*—R. E. Krisher, Jr.; A. B. Lowe

[57] ABSTRACT

Predetermined portion or segment of an insulated conductor is positioned adjacent to a first contact, and thereafter conductor is sequentially engaged with spaced apart teeth of a second contact. Preferably, insulation is extruded away from contact points. Second contact is moved through a curved path so as to sequentially pinch conductor at spaced apart locations. In another form, conductor segment is positioned in predetermined position and move multi-toothed connector in an arcuate manner to establish electrical contact. Apparatus effects swinging motion of multi-toothed connector or contact relative to first member and insulated wire segment so as to exert relatively great forces against first end of segment, and insure complete and adequate penetration of insulating coating to insure good electrical circuit. Electrical connector assembly includes first jaw and second jaw movable through arc relative to first jaw. Each jaw has contact portion formed with teeth having cutting face. The teeth on facing jaw portions have cutting faces disposed in opposite directions. Teeth on at least one jaw sequentially bite into axially spaced apart portions of insulated wire segment, extrude wire insulation material, and establish contact with wire conductor. Jaws handle range of conductor sizes. Contact portions of jaw asemblies fabricated from file segments and clamped in place. Contacts have at least two working surfaces and it is possible to reorient contact to provide new working surface. Shim means may be selectively added or removed to accommodate conductors having sizes within different predetermined ranges of conductor sizes.

3 Claims, 8 Drawing Figures

FIG. 3
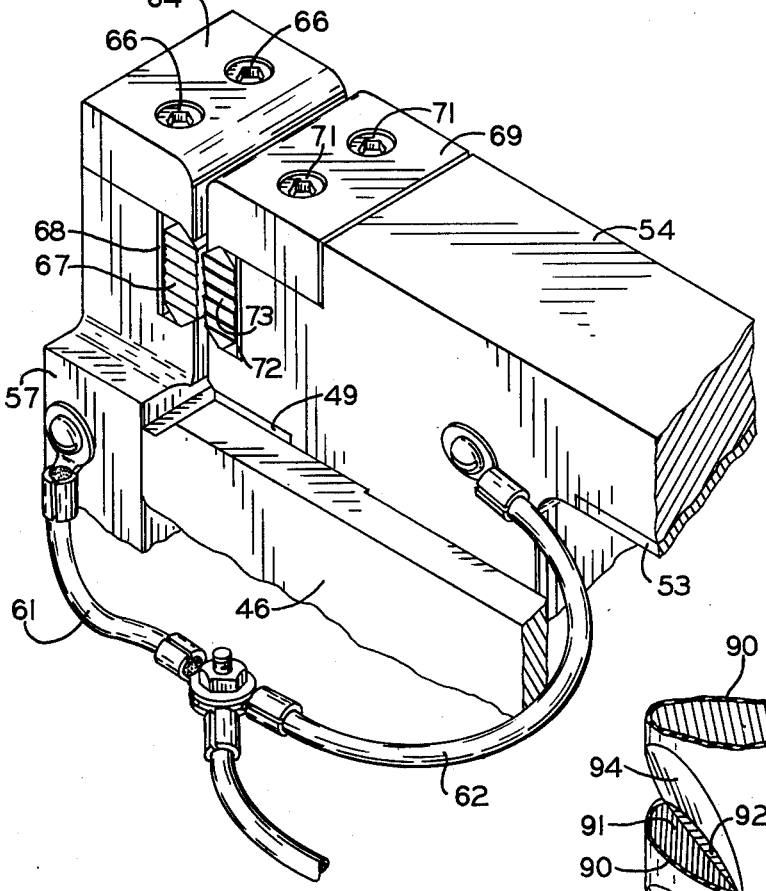
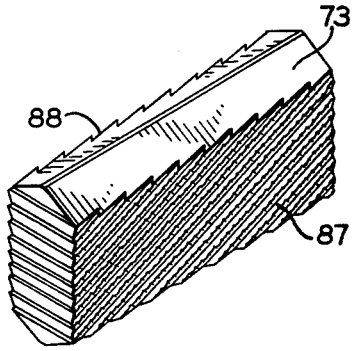
FIG. 4
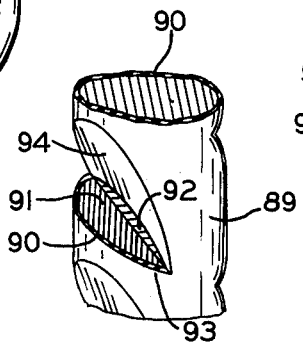
FIG. 5
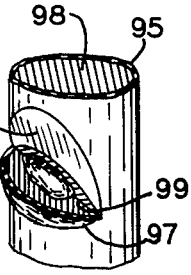
FIG. 6
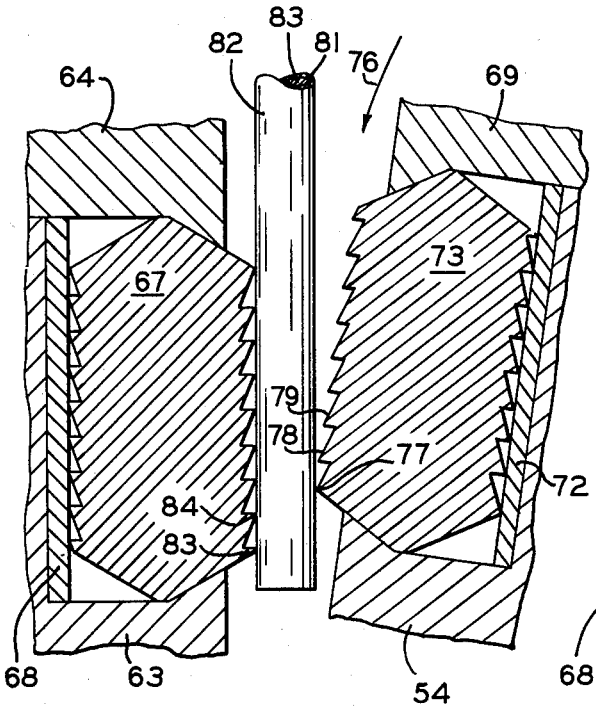
FIG. 7
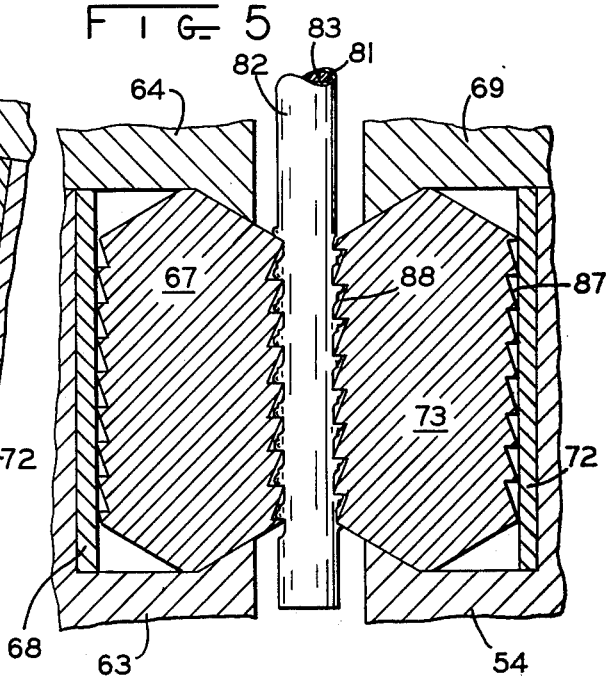
FIG. 8

APPARATUS FOR ESTABLISHING MULTI-POINT ELECTRICAL CONTACT WITH AN INSULATED CONDUCTOR

BACKGROUND OF THE INVENTION

The present invention relates to methods of establishing multi-point contact with insulated conductors, and electrical connectors for use in conjunction with high energy rate supply circuits where frequent connections are required to be made between the circuit and the end portions of one or more insulated conductor wires.

Smotherman U.S. Pat. No. 3,391,379 (issued July 2, 1968) describes, among other things, the desirability of establishing good multi-point contact with insulated conductors that are thus connected with high energy rate supply circuits. While the Smotherman teachings may be applied to different types of situations; one particular type of application of equipment and apparatus in which it is extremely desirable to consistently establish proper contact is taught, for example, in Baldwin U.S. Pat. No. 3,407,468 which issued Oct. 29, 1968. These two patents are assigned to the assignee of the present application, and the entire disclosures of said Smotherman and Baldwin patents are incorporated herein by reference.

I have determined that when prior methods and constructions are utilized, connector elements must be replaced with relative frequency. It is believed that at least part of this problem is because prior connectors actually make good contact in only a few places along a conductor. Then, when high current surges are applied (e.g., 400 to 500 amperes in 4 to 6 milliseconds); an arc may be established that can destroy the segment of conductor adjacent to the connector and also destroy one more contact points; or teeth on the connector. This destruction of a connector contact point more frequently appears in connection with a pitted or burned spot on the connector. It has seemed that second, and then third, burn spots have developed relatively soon after the first "burn"; and three "blows" or burns have usually been taken as an indication that a new connector must be provided.

Prior arrangements have used soldering or brazing techniques for making permanent connections between a power supply lead and a connector. This in turn has necessitated the use of a relatively large amount of time for replacement of connectors that have been damaged due to arcing, pitting, or any other reason.

In high production situations, it often is desirable to provide current surges to devices having conductors of a given size within a predetermined range of sizes. Prior connector arrangements have been somewhat deficient in ability to make good electrical connections with a wide range of wire sizes. For example, when a prior connector construction was relatively reliable for making connections to a first conductor size; if connections then were attempted with a second conductor size that differed too much from the first size, arcing might occur that would destroy the connector jaw. Then the difficulty associated with replacing connector surfaces would again be apparent. Of course, the difficulty of replacing connector surfaces would also be apparent when changing connector members so as to better accommodate different sizes of conductors.

When prior connection means are used, a build-up of magnet wire insulation residue may occur on connector jaws and eventually lead to relatively bad electrical connection between the contact jaws and the conductor portion of a length of insulating magnet wire. When this occurs, arcing may occur between connector jaws and the magnet wire with the result that burning and pitting of the contact jaws may take place. It will be appreciated that the magnet wire also may be vaporized by the arcing action with the result that a portion of the lead wire is destructed. Even more importantly, when arcing occurs, the surge of energy delivered from a power supply may be dissipated during destruction of the magnet wire segment and a desirable coil transforming operation (as described for example in the referenced Baldwin patent) may not take place.

Accordingly, it would be desirable to provide an improved method of establishing a secure and positive electrical connection with a minimum amount of damage to conductor leads. Moreover, it would be desirable to provide an improved structural arrangement whereby, even if connectors eventually deteriorate, the contact portions of the connectors may be rapidly and quickly replaced with readily available structural members in an inexpensive and facile manner. It would even be more desirable to provide an arrangement whereby good electrical connection may be assured between a connector and the conductive portion of an insulated section of a range of magnet wire sizes. Desirably, the useful life of contact members would be increased as compared to prior arrangements, and magnet wire insulation on a conductor would be extruded away from portions of a conductor so as to avoid build-up of stripped insulation on a connector surface.

SUMMARY OF THE INVENTION

Accordingly, it is a general object of the invention to provide new and improved methods for establishing connections with insulated conductor segments of inductive devices.

It is a further object of the present invention to provide a new and improved electrical connector that extrudes insulation from a conductor and simultaneously establishes good electrical contact with a conductor.

It is yet another object of the present invention to provide a new and improved electrical connector that may be used with a range of sizes of insulated conductors.

It is yet another object of the present invention to provide a new and improved connector arrangement having connector surfaces that can be quickly and economically replaced or renewed.

In accordance with one form of the invention, I have provided an improved method of establishing a secure and positive electrical connection, in a reliable manner, with a minimum of damage to a conductor lead.

In carrying out the invention in a preferred form, I position a predetermined portion or segment of an insulated conductor adjacent to a first contact, and thereafter sequentially engage the conductor with spaced apart teeth of a second contact. Preferably, I extrude insulation away from contact points. In a preferred embodiment, I move the second contact through in a curved path so as to sequentially pinch the conductor at spaced apart locations. In still another form, I position a conductor segment in a predetermined position and then move a multi-toothed connector in an arcuate manner to establish electrical contact with the conductor segment. In one form, I provide apparatus that is used to effect a swinging motion of a multi-tooth connector or contact relative to a first member and an insulated wire segment so as to exert relatively great forces against a first end of the segment, and so as to tend to insure complete and adequate penetration of an insulating coating in a manner that contributes to insuring establishment of a good electrical circuit between at least one contact jaw and the conductor portion of the insulated wire segment.

In carrying out the invention in forms illustrated herein, I provide at least one electrical connector assembly that includes a first jaw, and a second jaw movable through an arc relative to the first jaw. Each of the jaws have contact portions formed with teeth that have a cutting face. The teeth on the contact face of the first jaw have their cutting faces disposed in one direction while the teeth on the contact portion of the movable jaw have their cutting faces disposed in an opposite direction. By swinging the second contact jaw through an arc relative to the first jaw, the teeth on the second jaw sequentially bite into axially spaced apart portions of an insulated wire segment, extrude wire insulation material, and establish contact with the wire conductor. The contact jaws handle a satisfactory relatively wide range of conductor sizes. In accordance with another feature, I provide an arrangement whereby contact portions of connector jaws may be fabricated from readily available materials and positioned so as to be readily clamped and unclamped in the apparatus. In more preferred forms, each contact has at least two working surfaces so that when a first working surface is damaged or becomes ineffective, it is necessary only to reorient the contact relative to the contact carrier and provide a new working surface. In still other forms, I provide shim means that may be selectively positioned, added or removed, so that proper selection of such means may be accomplished in an inexpensive and facile manner, and better to accommodate conductors having sizes within different predetermined ranges of conductor sizes.

The subject matter which I regard as my invention is set forth in the claims appended to and forming a part of this specification. The invention itself, however, together with further objects and advantages thereof may be better understood by referring to the following description taken in conjunction with the accompanying drawings wherein like reference numerals have been used to identify like parts.

FIG. 3 is a view in perspective of part of the clamping jaw that is shown in FIG. 2;

FIG. 4 is an enlarged perspective view of a multi-toothed, multi-working face connector utilized in the clamping jaw of FIG. 3;

FIG. 5 is a perspective fragmentary view of a portion of an insulated conductor illustrating an incision effected by two teeth of a contactor during practice of the invention in one form;

FIG. 6 is a perspective fragmentary view of a portion of another insulated conductor illustrating an incision effected by two teeth of a contactor during practice of the invention;

FIG. 7 is an enlarged view of opposed contacts of the clamping jaw of FIG. 2; and FIG. 8 is an enlarged view of the contact portions shown in FIG. 7, but wherein the clamping jaws are shown in a final position thereof in a conductor-biting, insulation-extruding position.

Description of the Preferred Embodiments

Figure 1:
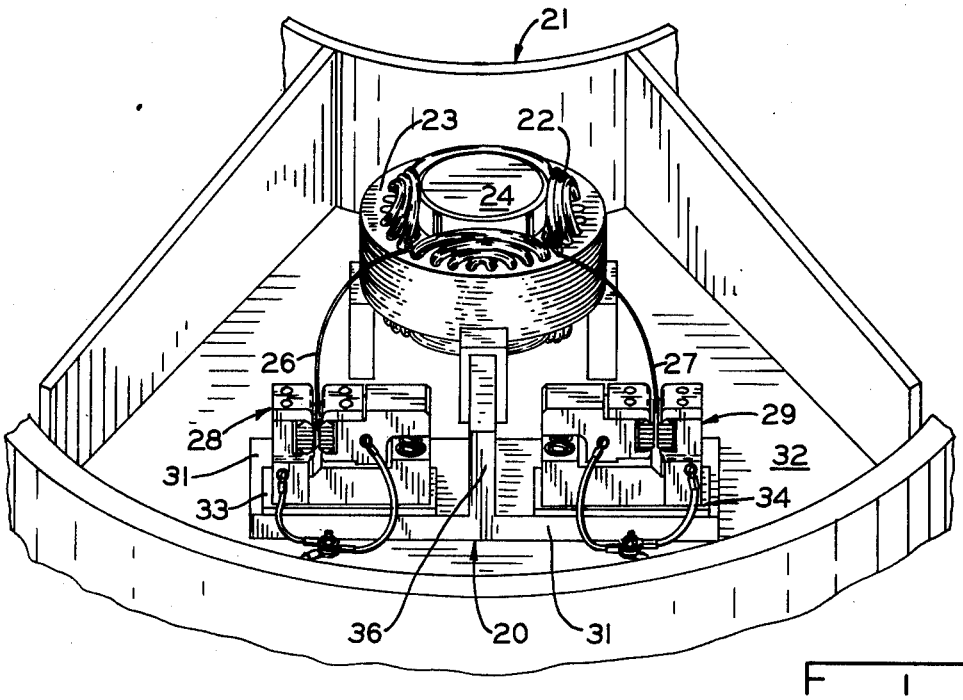
FIG. 1 is a perspective view of a portion of apparatus that may be used to practice my invention in one form thereof, that also embodies my invention in one form, and that may be used, for example, to connect the leads of a stator winding in circuit with a high energy rate supply circuit.

Referring now to the drawings in more detail, and more particularly to the view shown in FIG. 1, apparatus 21 includes a suitable power supply (as described for example in the Baldwin patent), and, among other things, an improved connector assembly 20. The apparatus 21 may be used, for example, for altering the configuration of a stator winding 22 that is disposed on a magnetic stator core 23 of an electric motor. As will be appreciated from a review of FIG. 1, the magnetic stator core 23 may be positioned on a cylindrical member 24. A pair of leads 26, 27 that extend from the stator winding 22 are connected to the supply circuit by means of the connectors 28, 29. An operator who would be operating the apparatus 21 would stand in proximity to such pparatus so that the operator could handle the leads 26, 27; and insert the leads between the jaws or contacts of the connectors 28, 29.

For example, an operator may depress a not-shown foot pedal (or any other conveniently located suitable device) and cause the connectors or jaws of the connectors 28, 29 to open. The operator would then position the leads 26, 27 in (respectively) the connectors 28, 29, and release the foot pedal so that the connectors 28, 29 would clamp respective ones of the winding leads.

It will be understood that in carrying out coil transforming operations with the apparatus 21, each stator winding must be connected to the supply circuit. Then, after one or more high energy pulses are discharged through the stator winding 22, it is disconnected from the supply circuit. Typically, an operator may handle a number of stator windings at rates as indicated, for example, in the above-referenced Smotherman U.S. Pat. No. 3,391,379. Based on those rates, the connectors 28, 29 would be opened and closed in excess of about 500 times per hour. A more complete description of the supply circuit and other details of apparatus 21 may be had by referring to the referenced William E. Baldwin patent.

Still referring to FIG. 1, the left-hand and right-hand connectors 28, 29 are mounted in a common support block 31. The support block 31 may be attached to the table 32 by any suitable means, for example, screws. Each of the connectors 28, 29 are insulated from the support block 31 by means of a block of insulating material 33, 34 respectively. It will be appreciated that any number of connectors may be used and the actual number used in fact will depend upon the total number of leads that are to be separately connected.

For example, in the event that a dual station were provided so that two stator cores 23 were supported at the station illustrated at FIG. 1 (rather than a single core as shown), four connectors would be used, and it would be more convenient to position two connectors on each side of the vertical dividing strut 36 of the support block 31. When this is done, it also is desirable to reorient the connectors 90° relative to the position thereof shown in FIG. 1. Thus, two connectors, positioned in side-by-side relationship, would fit on either side of the separating strut 36.

Since the connectors 28, 29 are structurally identical one to another, only the connector 28 will be now described in more detail, reference being had to FIGS. 2–7. It should be understood however, that the detailed description of the structural features and mode of operation of connector 28 that will now be presented is also applicable to connector 29.

Figure 2:
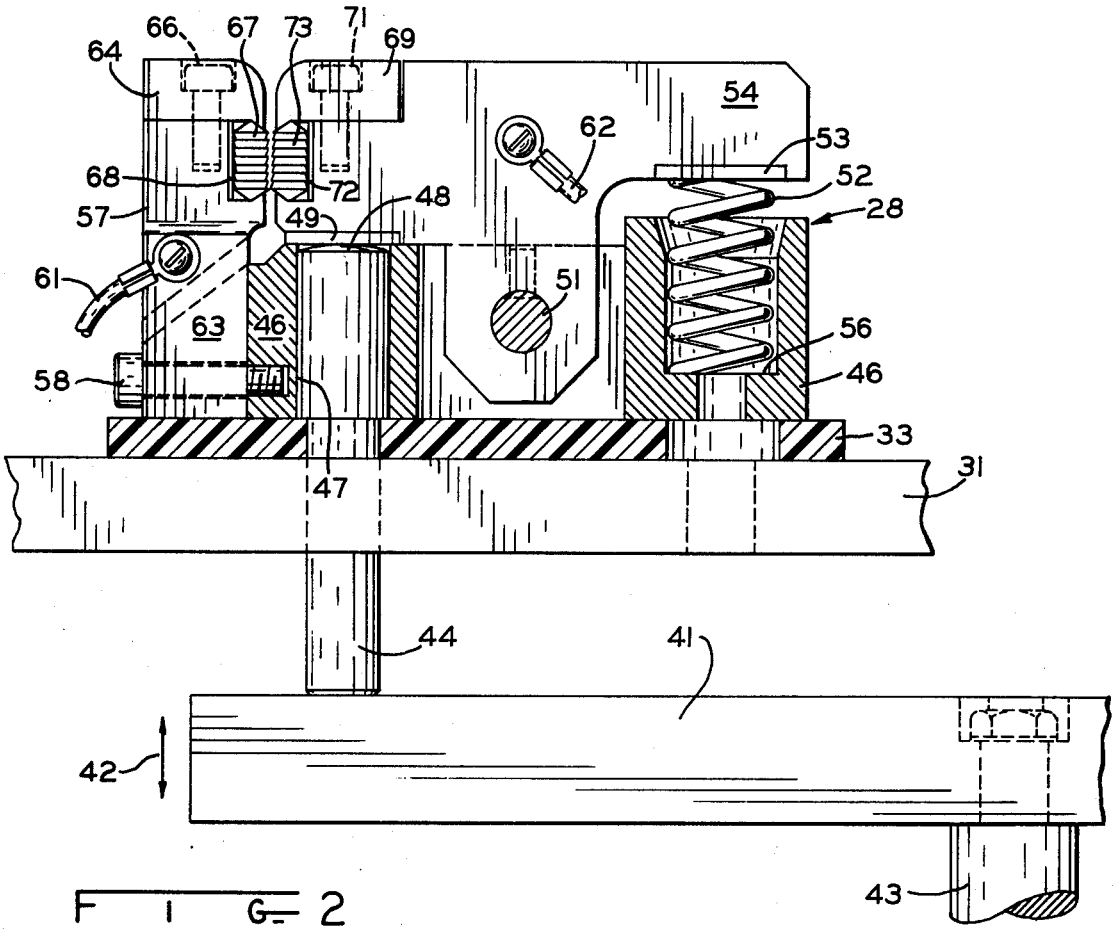
FIG. 2 is an enlarged vertical sectional view, with parts removed and parts broken away, showing a detail of a clamping jaw of the apparatus of FIG. 1, and a jaw actuating mechanism.

With reference now to FIG. 2, it will be noted that a push block 41 has been shown that is movable along the direction line of arrow 42 as push rod 43 is actuated by a foot pedal linkage or other suitable means. Although materials other than those now to be mentioned could be used for the various parts of assembly 28, specific materials of one specific exemplication will be given for purposes of description.

As push block 41 moves upwardly as viewed in FIG. 2, it drives steel releasing rod 44 upwardly through a bearing hole 47 formed in base 46 that is made from hot-rolled steel. The upper end 48 of rod 44 will then bear against steel wear pad 49 that is carried by a brass jaw part 54 that forms part of a movable jaw assembly.

Thereupon, the jaw assembly will pivot about steel pivot pin 51 that is held by base 46; with this movement compressing a thirty-five pound die spring 52 between steel wear pad 53 carried by jaw part 54, and spring seat 56 of the base 46.

A stationary jaw assembly 57 is fastened to base 46 with screws 58; and power circuit leads 61, 62 connect both jaw assemblies to one side of the power output.

It will be understood, of course, that assemblies 28, 29 (of FIG. 1) are connected to the power supply output (e.g., to ground and the high voltage output, respectively), so that current will flow through the series arrangement of a first connector assembly, the winding 22, and then the second connector assembly.

Turning back to FIG. 2, the stationary jaw assembly includes a brass jaw part 63, a brass clamping block 64, a steel or brass clamping screw 66, a replaceable contact 67, and a shim 68. Similarly, the movable jaw assembly includes a brass clamp 69, a steel or brass screw 71, a shim 72, and a replaceable contact 73.

When rod 44 moves upwardly, as viewed in FIG. 2, the movable jaw assembly pivots about pin 51, and a wire segment receiving opening is provided between contact members 67, 73. An insulated wire segment then is positioned adjacent one of the members 67, 73 (preferably stationary member 67) and the rod 44 is permitted to return to its lower position under the force of spring 52.

The spring 52 will cause the teeth of the contacts 67, 73 to sequentially bite into the conductor segment, slice through and extrude insulation material; and perhaps extrude at least some small amount of conductor material while the teeth of the contacts establish a good electrical connection with the conductive portion of the insulated wire segment.

FIGS. 7 and 8 best illustrate the sequential electrical contact that is made as contact 73 moves through an arc as indicated at 76 in FIG. 7. As contact 73 moves in this manner, the teeth 77, 78, 79 etc., sequentially pierce insulation 81 on the insulated wire segment 82 so that contact is established between conductor 83 and contact 73. At this same time, teeth 84, 85, etc., pierce insulation 81 and contact conductor 83. When contact 73 comes to rest, the general appearance of conductor 82 and relative positions of contacts 67, 73 will be as shown in FIG. 8.

Steel shims 68, 72 may be removed so that a wider gap will exist between the faces of contacts 67, 73. In this event, the structure will properly engage and pierce insulation and make good electrical contact with conductors within a different range of sizes as compared to the size range that may be handled when shims 68, 72 are in place (as shown in FIGS. 2, 3, 7, and 8).

The contacts 67, 73 may be formed in suitable manner, but it is preferred that they be formed from commonly available file material. It is even more preferred that the contacts have at least two surfaces which have teeth so that a first toothed surface may be replaced by a second toothed surface. The contact 73, for example, was made by cutting a short section from a double sided, 10 teeth per inch, bastard file. The faces 87, 88 are each provided with teeth that will cut through magnet wire insulation, and the arcuate movement of the face of contact 73 insures that such cutting will take place.

It will be noted that clamp parts 64, 69 may be loosened (by loosening clamping screws 66, 71), contacts 67, 73 be repositioned so that an unused face will be in position for use as a connector, and clamp parts 64, 69 may then again be clamped down on the contacts. It is also easy to merely replace contacts 67, 73 with new contact segments.

With reference now to FIGS. 5 and 6, two conductor segments have been shown (to an enlarged scale) to at least generally indicate the appearance thereof after a connection has been made with the contacts 67, 73.

FIG. 5, represents the appearance of a segment of aluminum magnet wire 89. A tooth of a contact has sheared through the insulation coating 90 so as to expose conductor material at 91. When viewed under a microscope, a portion 92 of the conductor material had an appearance slightly different from the portion at 91. It is presently believed that this difference in appearance may have been caused by high temperatures that accompanied a high current surge into the area 92. The conductor was slightly extruded or "shaped" (along with the insulation) in the region 93. Insulation was visible at 94, and it appeared that a contact tooth had sliced through the insulation coating, extruded or moved insulation and conductor material to region 93, and made good electrical contact with conductor material. The conductor of wire 89 had a bare diameter of about 0.0539 of an inch; whereas a copper conductor wire, now to be discussed had a bare diameter of about 0.038 of an inch.

FIG. 6 is somewhat similar to FIG. 5, and differs therefrom in that a segment of copper magnet wire (somewhat smaller in diameter than the aluminum magnet wire represented by FIG. 5) was inspected. Insulation 95 was present at region 96, insulation and conductor material appeared to have moved to region 97, and conductor material 98 was exposed in region 99 where electrical contact had been made.

With reference again to FIG. 7, it is believed that more clamping force is applied by each contact tooth in the FIG. 7 arrangement than would result if a fixed "bite angle" were established for the entire contact surface movement. Thus, upon initial contact by tooth 77, a maximum piercing force is applied at substantially one tooth edge rather than having the force distributed, substantially uniformly, across a number of contact teeth such as would occur if the contact 73 moved in substantially a straight line rather than in an arcuate path.

It also is specifically noted that, for some applications, where it is contemplated that adequate contact can be established by just one of the contacts 73 or 67; the other contact could be replaced with a relatively planar, non-insulation piercing, supporting surface. It is preferred for most cases, however, that the supporting or reaction member have insulation piercing edges or teeth as illustrated in FIGS. 7 and 8. It again is noted that conductors with a size of from 0.010 to 0.042 of an inch have been satisfactorily connected with the structure as shown and described in FIGS. 7 and 8.

From the foregoing, it will be understood that I have provided new and improved methods, apparatus, and parts thereof, that are useable with reliability, result in good contact life, and wherein contacts may readily be arranged to have renewed surfaces or be changed in their entirety. Moreover, although the arcuate motion of a toothed contact has been emphasized and exaggerated somewhat for purposes of explanation and illustration in FIG. 7; at the present time it is believed that the arcuate movement of contact teeth and at least somewhat sequential engagement of contact teeth resulting therefrom is the reason for the satisfactory results associated with use of the present invention. In other words, the contact "pinches" the conductor from the bottom portion (as viewed in FIG. 7) to the upper portion.

While only preferred arrangements have been shown and described herein, it will be appreciated that many modifications and changes will occur to those skilled in the art. It is, therefore, to be understood that the appended claims are intended to cover all such modifications and changes that fall within the true spirit and scope of the invention.

What I claim as new and desire to secure by Letters Patent of the United States is:

1. An electrical connector assembly for use in conjunction with connecting a high energy power circuit to an insulated conductor, said connector assembly including a stationary first jaw assembly having first spaced apart teeth and a second jaw assembly having second spaced apart teeth movable longitudinally relative to the first spaced apart teeth and along an arcuate path; each of said jaw assemblies having at least one contact portion formed with the spaced apart teeth, with the teeth having cutting faces; the at least one contact portion of the second jaw being movable along an arcuate path so that the spaced apart teeth thereof sequentially pinch and engage a segment of insulated conductor that is disposed adjacent to the first jaw assembly and that is engageable by the at least one contact portion of the second jaw; at least one of the contact portions of at least one of the jaw assemblies having at least one surface and being clamped between two portions of said at least one of the jaw assemblies, with an electrical circuit being established through at least one surface of the at least one contact portion so clamped; and wherein one jaw assembly includes a rocker arm; the at least one contact portion so clamped is carried by said rocker arm, the rocker arm is pivotable about a pivot member, and the assembly includes a spring that urges the rocker arm in a direction to pinch a segment of insulated conductor disposed adjacent to the first jaw assembly.

2. An electrical connector assembly for use in conjunction with a high energy supply circuit for making electrical contact with an insulated conductor, the insulated conductor having a coating of insulating material surrounding an electrical conductor; the said electrical connector assembly comprising a first reaction member and a jaw assembly movably supported relative to the first reaction member, said jaw assembly including a jaw; said jaw assembly having a contact portion formed with a plurality of teeth and clamped in the jaw; said contact portion having at least two spaced apart surfaces that each have insulation piercing protrusions thereon, and said contact portion being a segment of a double sided file.

3. The invention of claim 2 wherein a removable shim is positioned between the file segment and a file segment retaining portion of the jaw assembly.

* * * * *